United States Patent [19]

Bauerle et al.

[11] 3,951,501

[45] Apr. 20, 1976

[54] HOUSING FOR ELECTRICAL CONNECTOR

[75] Inventors: Gerhard Bauerle, Willsbach; Oswald Hubner, Neuenstadt, both of Germany

[73] Assignee: Bunker Ramo Corporation, Oak Brook, Ill.

[22] Filed: Sept. 10, 1973

[21] Appl. No.: 396,018

[30] Foreign Application Priority Data

Sept. 13, 1972 Germany ..... 2244910

[52] U.S. Cl. ..... 339/91 R; 339/107

[51] Int. Cl.² ..... H01R 13/54

[58] Field of Search ..... 339/75, 91, 103, 107

[56] References Cited

UNITED STATES PATENTS

| | | | |
|---|---|---|---|
| 2,899,669 | 8/1959 | Johanson | 339/91 R |
| 3,170,749 | 2/1965 | Johanson et al. | 339/107 |
| 3,293,591 | 12/1966 | Mayer, Jr. | 339/107 |
| 3,344,393 | 9/1967 | Hendee | 339/75 P |
| 3,409,858 | 11/1968 | Krehbiel | 339/91 R |
| 3,518,616 | 6/1970 | Lewis | 339/107 |
| 3,617,615 | 11/1971 | Balzer | 339/107 |
| 3,744,009 | 7/1973 | Teagno et al. | 339/91 R |

FOREIGN PATENTS OR APPLICATIONS

| | | | |
|---|---|---|---|
| 810,623 | 3/1959 | United Kingdom | 339/103 R |
| 735,458 | 11/1932 | France | 339/107 |
| 860,423 | 1/1941 | France | 339/91 F |
| 982,959 | 2/1965 | United Kingdom | 174/92 |

*Primary Examiner*—Joseph H. McGlynn
*Attorney, Agent, or Firm*—William Lohff; F. M. Arbuckle

[57] ABSTRACT

A housing for an electrical connector having a shell for mounting an electrical connector, attachment means for attaching the housing to a mating connecting housing and a cable clamp means for securement of a cable to be connected to the electrical connector. The shell, attachment means, and cable clamp are formed of a single piece of moulded material.

9 Claims, 3 Drawing Figures

HOUSING FOR ELECTRICAL CONNECTOR

BACKGROUND OF THE INVENTION

1. Field of the Invention

The field of the art to which the invention pertains is that of housings for electrical connectors, particularly insulative housings for securement of an electrical connector thereto and for providing a cable restraining clamp about the cable serving the connector.

2. Description of the Prior Art

Prior art connectors are known which provide an insulative housing for the connector, attachment means for attaching the housing to a mating connector housing, and cable clamp means. However, in the past, it was necessary to construct such housings from a variety of combination of elements constructed of different materials. For example, certain known connector housings are provided with two locking detents which lock with the respective notches of a mating receptacle housing. Others are provided with a shell having secured thereto, by a machine operation, a separate cable clamp means. Examples of prior art housings can be found in U.S. Pat. Nos. 3,509,909; 3,475,718; and 3,409,859.

A particular connector housing known in the prior art is that of U.S. Pat. No. 3,093,733. In such connector, one end of the connector housing has a nose hook which is insertable into a suitable recess of a mating receptacle housing and acts as a quasi hinge when the housing is rotated about the nose hook as a fulcrum. Rotating the housing in this manner brings the separate connectors into mesh and provides electrical contact through the two connector parts. In the known housing, a detent is formed on the end opposite the nose hook and is formed in the form of a steel spring plate. The detent can thus be engaged with a stationary projection on the mating receptacle housing. Although such a design enables a relatively good physical connection, such known housings have, nevertheless, certain disadvantages in that they are composed of several parts, are produced from a variety of different materials, and often the cable clamp means is insufficient for firm securement of the electrical cable in place.

SUMMARY OF THE INVENTION

It is therefore an object of the present invention to provide an improved electrical connector housing not subject to the above disadvantages.

Another object of the invention is to provide a connector housing which has an extremely simple compact design, is easily manufactured, and insures rapid and safe connection and disconnection, both physically and electrically.

According to the invention, the objects of the invention are met by the provision of a housing comprising a shell having means for mounting an electrical connector, attachment means for attaching the shell to a mating connector housing, and cable clamp means for securement of a cable connected to the electrical connector; the shell, attachment means, and cable clamp means being of a single piece of moulded material, preferably of moulded plastics material.

The advantages of such a construction are numerous. For example, the entire housing can be die-cast formed of one single piece, thereby reducing manufacturing costs. Assembly costs are also reduced because of the non-necessity of attaching a separate cable clamp to the housing. The logistics aspect is thus improved because the storage of parts for the assembly of such a housing is minimized. Thus, an inexpensive housing for electrical connectors may be produced which provides all of the advantages of known electrical housings and in addition provides the important aspect of providing strong, reliable clamping of the cable serving the connector. Such a product finds use in many areas of production, and in particular is ideal for those applications in which the cable is exposed to considerable impact stresses, for example, those stresses which are experienced in motor vehicles by connectors for the electrical cables connected to a fuel injection control system.

The housing according to this invention is preferably of the elongated type, although not restricted thereto, having an attachment means at each end thereof. Although other arrangement means are possible, in a preferred embodiment of the invention at least one of the attachment means is in the form of a flexible depending latch arm having a detent hook at its free end. The hook is engageable with a flange or detent on a mating connector housing and is releasable therefrom by manually flexing the latch arm to release the hook from the detent.

Although such a latch arm might be provided at both ends of the connector, in a preferred embodiment of the invention a nose hook is provided at one end while a flexible latch arm provided at the other. In such an arrangement, the housing can be released with the aid of a single finger introduced underneath a release lever connected the the flexible latch arm. In certain known electrical housings, a tool must be utilized in releasing the latches, or at least both hands are required to effectuate proper release of the locking detent.

The cable clamp means is comprised of two mating cable clamp halves joined together by a thin web of moulded material, one of the halves being firmly joined to the shell. This permits the other of the halves to be swung away from the first half and allow unobstructed manipulation of the cable entering the shell. Such construction also permits the separation and stripping and initial preparation of the ends of each wire of the cable without the necessity of having first threaded the end of the cable through the connector housing. After the cable is thus inserted into one of the cable clamp halves, the other half is swung down around the cable and attached to the first half by suitable fastening means.

A sealing ring or packing may be provided about the end of the cable and positioned in a recess in the cable clamp halves. Thus, in addition to effecting good physical clamping of the cable, the inner cavity of the housing may be protected from the environment.

BRIEF DESCRIPTION OF THE DRAWINGS

The invention will now be described in detail with reference to the accompanying drawings representing a preferred embodiment of the housing for an electrical connector.

DESCRIPTION OF THE PREFERRED EMBODIMENT

Figure 1:
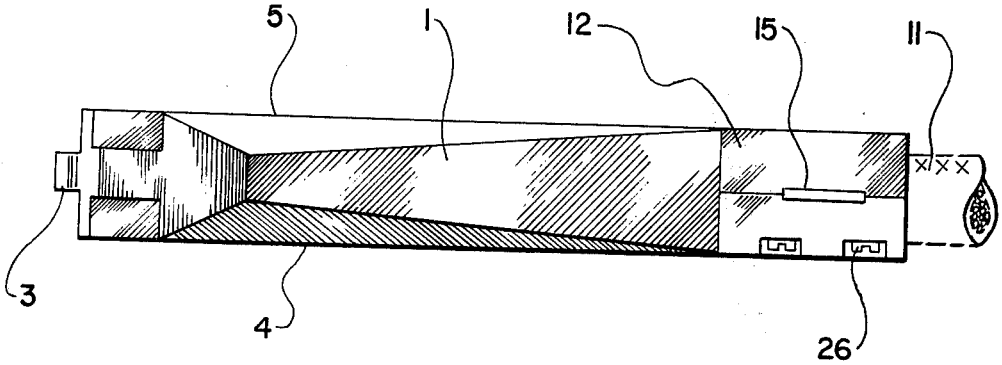
FIG. 1 is a top view of a connector housing with the two cable clamp halves bolted together.
Figure 2:
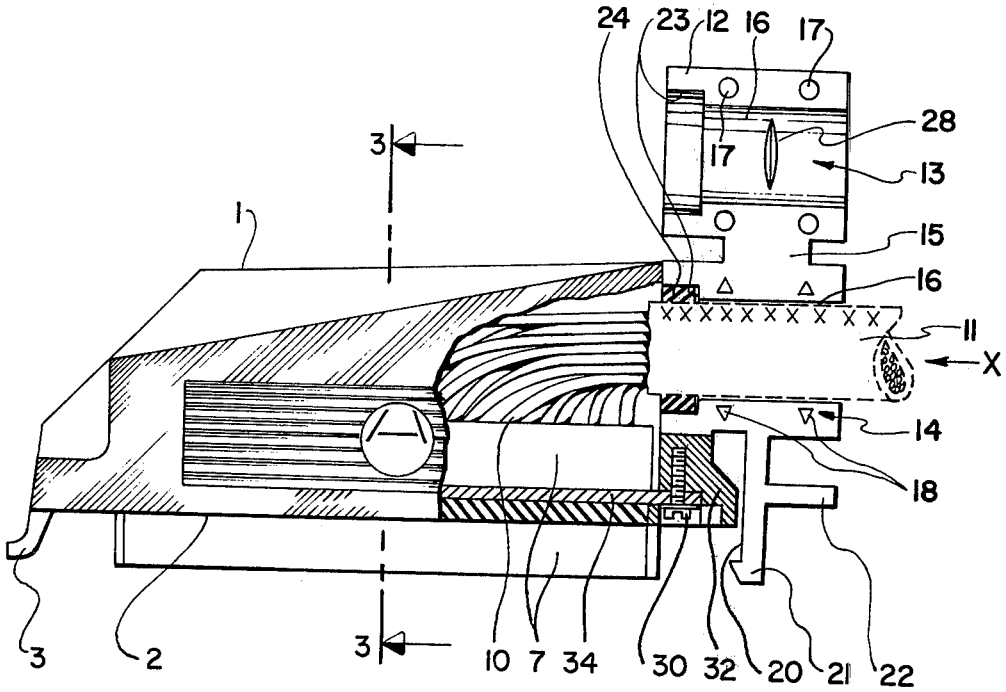
FIG. 2 shows a side view of the housing in accordance with the invention with a partial cross-section at the end of the housing having the cable clamp means and with the two cable clamp halves separated.

Referring to FIGS. 1 and 2, the connector housing is generally defined by a shell 1 having a generally elongated parallelepiped shape. A nose hook 3 extends away from one end of the shell for insertion into an opening of a mating connector housing. The nose hook 3 extends below the lower housing surface 2 and is slightly bent forward at its front end. In this manner, the nose hook 3 can be introduced into an opening or eyelet of a mating connector housing and acts as a hinge pivoting the shell 1 about the end of the nose hook as a fulcrum, in order to properly align a plug connector 7 mounted in shell 1 with a mating connector (now shown).

Figure 3:
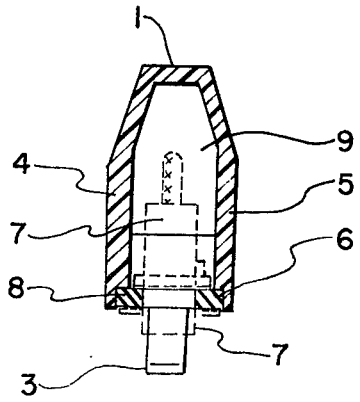
FIG. 3 is a sectional view taken along line 111—111 in FIG. 2, with the connector shown in broken lines.

As seen in FIG. 3, the housing has a cross-section in the shape of an inverted U. On the ends of the downwardly directed arms 4 and 5 of the U, the edges of an electrical connector rest. Recesses 6 are provided on the inner edge of each of the arms of the U to accept a sealing element 8 to protect the inner cavity 9 of the shell 1 from the environment. In the cavity 9, the wires 10 of the multi-wire cable 11 extend and connect to the electrical connector 7.

The end of the electric connector 7 has a flange 34 with a hole therein to accept a bolt 30 which is, in turn, secured to the heel 32 of the shell 1.

As shown in FIG. 2, a cable clamp 12 is formed on one end of the shell 1 opposite from (although equally positionable on) the end having nose hook 3. The cable clamp 12 includes two halves 13 and 14 which are substantially similar in appearance and in cross-section. Each half 13 and 14 includes a semi-circular or ellipsoidal channel 16 which represent the area to be occupied by a cable 11. The two halves 13 and 14 are interconnected by a thin web 15 acting as a hinge, so that the top half 13 can be swung down into mating relationship with half 14.

Each half 13 and 14 also has at one end of its semi-circular channel 16 a semi-circular recess 23 in which a sealing ring 24 is inserted.

The lower half 14 of the cable clamp 12, being made of the same piece of moulded material as shell 1 is firmly joined to the shell, while the upper half 13 of the cable clamp is flexibly pivotable about web 15 as an axis. In this manner, when the upper half 13 is brought into mating relationship with the bottom half 14, a strong, firm clamp is made about cable 11. As shown in FIG. 2, the cable 11 is introduced into the shell 1 in the direction of arrow X and lies initially in channel 16 of cable clamp half 14.

After the cable 11 with the sealing ring 24 in place is positioned in channel 16 of the lower cable clamp half 14, the upper half 13 of the cable clamp 12 is swung downwardly about web 15 acting as a hinge and against the lower half 14. In this manner, the two semi-circular channels 16 and the sealing ring 24 completely surround the cable 11.

Fastening means 17, 18 are provided on the two cable clamp halves 13 and 14 in order to secure the two halves together. The fastening means may be in the form of interconnecting projections which snap-fit together or in the form shown in FIGS. 1 and 2 wherein bolts 26 are inserted in apertures 17 and threaded through threaded holes 18. Depending upon the application and the need for strong stress relief of the end of the cable, one or the other of a variety of fastening means will be employed.

On the lower side of the cable clamp half 14 is a downwardly extending latch arm 20 having a releasing lever 22 on the side remote from a detent hook 21, the entire latch assembly being moulded of the same piece of material as the shell 1 cable clamp halves 13 and 14, and nose hook 3. It will be obvious that the contacts on the connector 7 are arranged in sequence along the longitudinal axis of the connector and housing or shell 1 so that when the connector is pivoted about a transverse axis through the hook 3 at one end of the housing, the contacts of connector 7 engage in sequence with the contacts of the other or mating connector to engage or mate the contacts sequentially. Since the contacts normally engage under spring pressure, this substantially reduces the force required to engage the contacts while providing considerable leverage.

The latch arm 20 is shown as depending from the lower clamp half 14. However, it is contemplated that the latch arm 20 may be directly connected with the lower housing surface 2 near the end of the shell 1 remote from the nose hook 3. After sealing ring 24 has been inserted into the recess 23, the cable 11 introduced into the channels 16, the connector 7 and associated sealing elements 8 are in place, and the two cable clamp halves are fastened together, the assembly is ready for connection to a mating connector housing. The nose hook 3 is first introduced into the opening 42 provided therefor in the mating connector housing 40, and the entire assembly is then rotated clockwise (as viewed in FIG. 2) around an axis substantially at the tip of nose hook 3. When the connector 7 comes into contact with its mating connector, the detent hook 21 on the end of latch arm 20 locks with a detent or flange 44 on the mating connector housing. The connector housing is thus rigidly connected.

For disconnecting the housing from a mating housing, the operator has only to apply manual force from below against the releasing lever 22 (as seen in FIG. 2) and to lift the assembly in a counterclockwise motion about the nose hook 3, which is then easily removed from its opening in a manner reverse from that described above for connecting the housing to a mating housing.

As an aid to restrain the cable, a cable restraining dimple 28 may be provided in one or both cable clamp halves 13 and 14. The dimple 28 will tend to bite into the sheath of the cable when the two cable clamp halves are joined.

As an aid in disconnecting the housing and its associated connector, the shell 1 may have parallel serrations on each arm 4 and 5 of the U-shaped shell for improved gripping of the shell.

From the foregoing, it can be readily realized that this invention can assume various embodiments. Thus, it is to be understood that the invention is not limited to the specific embodiment described herein, but is to be limited only by the appended claims.

The embodiments of the invention in which an exclusive property or privilege is claimed are defined as follows:

1. A housing for mounting a first electrical connector carrying a plurality of contacts connected to respective conductors of a cable which has a sealing ring thereabout and to engage respective contacts of the second electrical connector mounted in a second connector housing which has an opening therein at one end and a shoulder at the other end, said housing for said first electrical connector comprising:

an elongate molded plastic shell of U-shaped cross section including walls defining an elongate cavity for receiving the first electrical connector;

mounting means for securing said first electrical connector to said shell;

attachment means integrally molded with said shell for attaching said shell to the second housing of the second electrical connector, including a nose hook at one end of said shell for insertion into the opening in the second housing to form a pivot for said first electrical connector, and a flexible latch arm at the opposite end of said shell flexing to releasably engage the shoulder of the second housing; and cable clamp means integrally molded with said shell for securing the cable to said shell, said cable clamp means comprising two mating halves and a thin web of molded material joining said halves, one of said halves firmly fixed to said shell and the other half hinged to said one half by said thin web, each of said halves including a semi-circular recess therein for receiving corresponding portions of the sealing ring disposed about the cable, and means for securing said halves about the cable.

2. A housing according to claim 1, wherein the shoulder of the second housing is formed in a detent and wherein said latch arm comprises a free end carrying a detent hook to engage the detent shoulder.

3. A housing according to claim 1, wherein said elongate shell includes a recessed edge and said mounting means includes sealing means received in said recessed edge for embracing said first electrical connector.

4. A housing according to claim 1, wherein the side arms of the "U" have parallel serrations on the outer surfaces thereof to aid in gripping said shell.

5. The housing as claimed in claim 1, wherein at least one of said halves has a plurality of apertures therein to permit insertion of fastening means to secure the two halves together when said other half is swung into mating relationship with said one half.

6. The housing as claimed in claim 1, wherein at least one of said halves has a dimple projecting into the area to be occupied by a cable when said halves are in mating relationship.

7. The housing as claimed in claim 1, wherein said flexible latch arm includes a laterally projecting release lever operable upon application of manual force thereto to release said latch arm from said detent.

8. The housing as claimed in claim 1, wherein said cable clamp halves have interlocking attachment means formed thereon.

9. A housing for a first electrical connector carrying a plurality of contacts with each contact adapted to be connected to a respective conductor in a cable and each arranged for engagement with a respective other contact in a second connector housing having a detent comprising:

an elongated shell having means for mounting said first electrical connector;

attachment means for attaching said shell to a said second connector housing, said attachment means comprising a nose hook extending away from one end of said shell for insertion into said second connector housing to pivot said first connector about an axis adjacent one end of said shell and sequentially engage each contact of said first plurality of contacts with a respective other contact, and a flexible latch arm depending from the opposite end of said shell for engagement with said detent on said second connector housing; and cable clamp means for securement of said cable to said shell, said cable clamp means comprising two mating cable clamp halves joined together by a thin web of moulded material, one of said halves being firmly joined to said shell, thereby to permit the other of said halves to be pivoted from said one half to allow unobstructed manipulation of the cable entering said shell and pivoted toward said one half to secure said cable to said shell independently of any supporting structure for the housings; and wherein said shell, said nose hook, said flexible latch arm, and said cable clamp means are of a unitary piece of moulded plastic material.

* * * * *